United States Patent [19]

Vullierme

[11] 3,962,817

[45] June 15, 1976

[54] TOY CONSTRUCTION ELEMENT

[76] Inventor: Paul Roland Vullierme, 2, rue de la Plaine, Rumilly, France

[22] Filed: Jan. 22, 1975

[21] Appl. No.: 542,934

[52] U.S. Cl. ..... 46/25
[51] Int. Cl.[2] ..... A63H 33/08
[58] Field of Search ..... 46/25, 24, 26

[56] References Cited

UNITED STATES PATENTS

| | | | |
|---|---|---|---|
| 3,481,068 | 12/1969 | Paulson | 46/25 |
| 3,566,531 | 3/1971 | Hasel et al. | 46/25 |

FOREIGN PATENTS OR APPLICATIONS

| | | | |
|---|---|---|---|
| 887,183 | 11/1971 | Canada | 46/25 |
| 676,469 | 7/1952 | United Kingdom | 46/25 |
| 1,051,087 | 12/1966 | United Kingdom | 46/25 |

*Primary Examiner*—Louis G. Mancene
*Assistant Examiner*—Jack Q. Lever
*Attorney, Agent, or Firm*—Karl F. Ross; Herbert Dubno

[57] ABSTRACT

A toy construction element comprises a rectangular wall formed with an apron whose edge defines a plane parallel to the wall. A plurality of parallel tubes arranged in a regular array pass through the base wall. The one end of each tube extending through the base wall has a predetermined inner diameter. The other end of each tube lies substantially at the level of the plane defined by the apron and has an outer diameter corresponding generally to the inner diameter. In addition this other end of each tube is cleft and is stepped between an outer region at the plane whose outer diameter corresponds to the inner diameter of the one end and an inner region of slightly greater diameter. Thus two such blocks can be fitted together with the other ends of the tubes of one block fitting into the one ends of the tubes of the other block, the skirt of the one block coming to rest on the wall of the other block.

4 Claims, 8 Drawing Figures

TOY CONSTRUCTION ELEMENT

FIELD OF THE INVENTION

The present invention relates to a toy construction element. More particularly this invention concerns a toy building block.

BACKGROUND OF THE INVENTION

Toy building blocks are known each of parallelepipedal shape and having an upper surface formed with a plurality of bosses. The lower surface of each of the blocks is formed with a plurality of concavities or sockets each adapted to receive a respective boss. Usually the block simply has an apron that engages around the bosses of the underlying blocks. The principal disadvantage of these systems is that they are relatively difficult for a child to line up in order to snap them together. Furthermore after much use they frequently wear and deform slightly so that a construction formed with such blocks comes readily apart. Another disadvantage is that it is difficult with such blocks to snap them together in any other than two different manners: either one directly on top of the other, or one half on top of the other.

OBJECTS OF THE INVENTION

It is therefore an object of the present invention to provide an improved toy construction element.

Another object is the provision of a toy building block which overcomes the above-given disadvantages.

Yet another object is the provision of a toy building block which can be easily fitted to another toy building block with a tight connection between them.

SUMMARY OF THE INVENTION

These objects are attained according to the present invention in a construction block comprising a generally planar wall having a pair of faces, an apron on the periphery of the wall extending from one of the faces thereof and having an outer edge defining a plane, and a plurality of tubes extending through and secured to the wall. Each tube has one end of predetermined inner diameter projecting through the wall beyond the other face thereof and another end lying generally at the plane and having an outer diameter corresponding generally to the inner diameter of the one end. Thus two such blocks can be fitted together by engaging the other end of at least some of the tubes of one block in the one end of at least some of the tubes of the other block, with the apron of the one block resting on the wall of the other block.

According to the present invention the apron is not connected to any of the tubes so that its sole function is decorative and as a limit to the interfitting of the two blocks, as the edge of the apron rests snugly on the face of the underlying block of two fitted together blocks.

In accordance with yet another feature of this invention each of the other ends of each tube is cleft and has an outer region terminating at the plane and separated from an inner region by a step. The outer region has a diameter substantially equal to the inner diameter of the one end and the inner region has an outer diameter which is slightly greater than this inner diameter. Thus the blocks can be very easily fixed together by slipping the outer region of the tubes of one block into the one ends of the other block. Then they are pressed tightly together so as to snap the inner region therein and hold them elastically tightly together. To this end the longitudinal flank of the outer region is shorter than the height of one end of the other face of the wall.

The blocks according to this invention are generally parallelepipedal and are very easily used by even a very young child. The provision of four or eight such tubes on each block allow them to be fitted together in a variety of manners, so that it is possible to stagger them in any manner.

BRIEF DESCRIPTION OF THE DRAWING

The above and other objects, features, and advantages, will become more readily apparent from the following description, reference being made to the accompanying drawing, in which.

SPECIFIC DESCRIPTION

Figure 1:
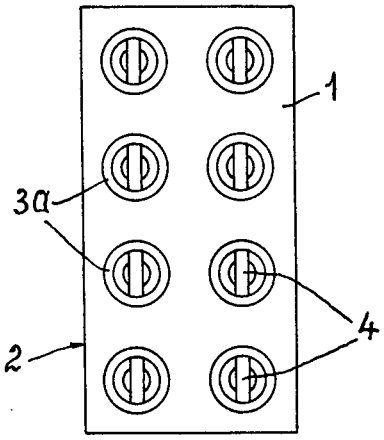
FIG. 1 is a top view of a block according to the present invention.
Figure 2:
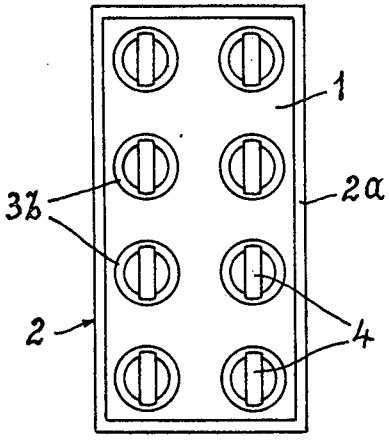
FIG. 2 is a bottom view of this block according to the present invention.
Figure 3:
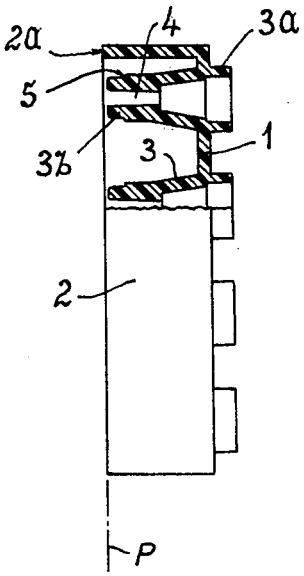
FIG. 3 is a side view partly in section of the block.
Figure 4:
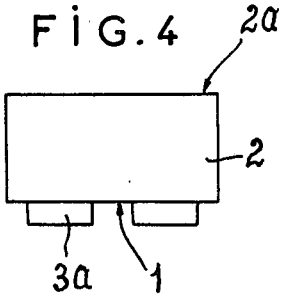
FIG. 4 is an end view of the block.
Figure 5:
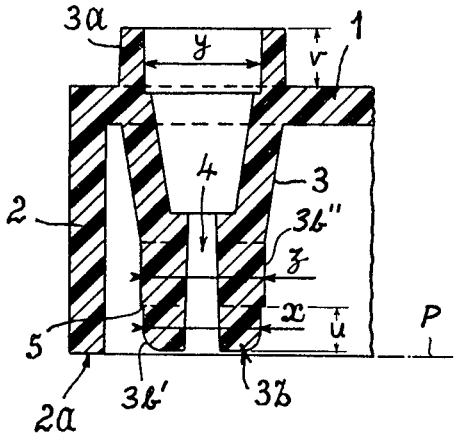
FIG. 5 is a large-scale sectional view of a detail of the block.
Figure 6:
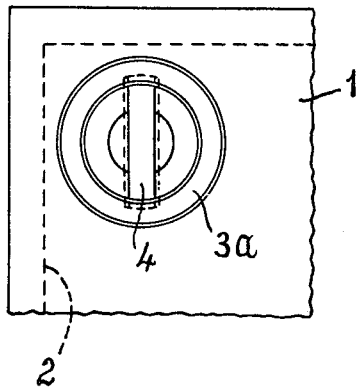
FIG. 6 is a top view of the detail shown in FIG. 5.

As shown in FIG. 1 a block made of polyethylene or polystyrene has a rectangular base wall 1 from one face of which extends a skirt or apron 2 defining a plane P. Eight tubes 3 are provided on the block passing through the wall 1 in two parallel rows of four. Each of these tubes 3 has one end 3*a* with an inner diameter *y* (FIG. 5). The other end 3*b* of the tube, which terminates just short of the plane P is formed with a split 4 and a step 5 between an outer region 3*b'* of a diameter *x* substantially equal to *y* and an inner region 3*b''* having a diameter *z* slightly greater than the diameter *y*. The split 4 in the portion 3*b* permits inward elastic deflection of the two sides of the regions 3*b'* and 3*b''*. The female tube end 3*a* has a height *v* above the upper face of the wall 1 and the step 5 is spaced by a distance *u* shorter than the distance *v* from the plane P.

Figure 7:
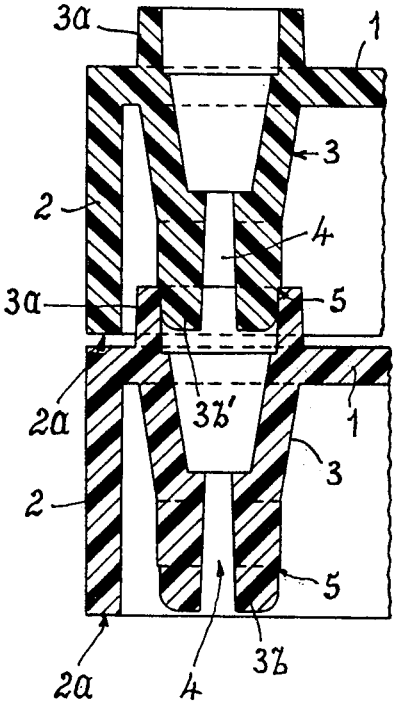
FIGS. 7 and 8 are vertical sections through details of two blocks in two different position as they are fitted together.
Figure 8:
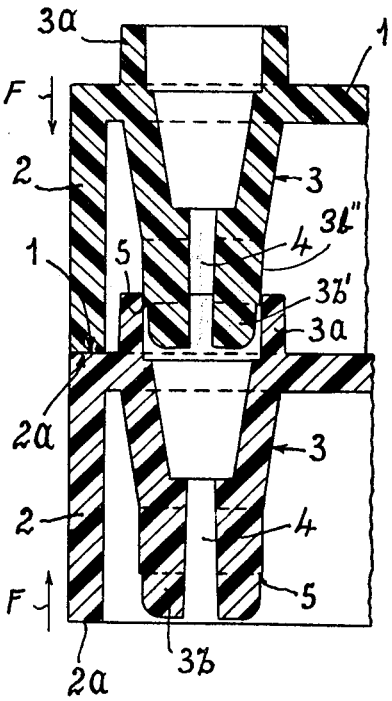

In use one block is placed atop another block as shown in FIGS. 7 and 8 the male outer region 3*b'* of at least one of the tubes 3 are fitted into the female upper region 3*a* of the tubes 3 of the underlying block. This interfitting is facilitated by the rounded lower ends of end regions 3*b'*. As shown in FIG. 7 the two tubes 3 slide together relatively easily until the upper edge of the female tube end 3*a* meets the step 5 of the male tube end 3*b*. This makes it very easy for even a young child to initially fit the two blocks together and align them properly. Once they are so aligned an exertion of extra force as shown by arrows F in opposite directions toward each other on the two blocks causes the end regions 3*b* to deform so that the step 5 enters in the female end 3*a* and the section 3*b''*, whose outer diameter *z* is substantially greater than the inner diameter *y*, and tightly secures the two blocks together. In this position the outer edge 2*a* of the apron 2 comes to rest snugly atop the wall 1 of the underlying block. A tight and attractive assembly is provided.

The blocks according to the present invention can therefore readily be snapped together so as to form a stable and tight assembly. It is also possible, in view of the provision of an even number of the tubes provided in two rows on a rectangular block to secure the blocks together in any other variety of manners. All of the tubes 3 of one row can be snapped into the tubes 3 of the lower row, or only a single corner tube of one block may be snapped into the diagonally opposite corner tube of the underlying block. The versatility with which these blocks may be interfitted makes it possible with such blocks to form roofs and other inclined structures that are impossible to make with prior-art toy construction elements.

I claim:

1. A construction block comprising a generally planar wall having a pair of faces, an apron on the periphery of said wall extending from one of the faces thereof and having an outer edge defining a plane, and a plurality of tubes extending through and secured to said wall, each tube having one end of predetermined inner diameter projecting through said wall beyond the other face thereof and another end lying generally at said plane and having an outer diameter corresponding generally to said inner diameter, whereby two such blocks can be fitted together by engaging said other ends of at least some of said tubes of one block in the one end of at least some of the tubes of the other block with the apron of the one block resting on the wall of the other block, each tube being adapted to penetrate at its said other end the said one end of a tube of the other block to a predetermined length of the said other end, said other ends of said tubes being cleft and having along said length a diameter slightly greater than said inner diameter, each of said other ends having an outer region terminating at said plane and of a diameter substantially equal to said inner diameter, an inner region between said outer region and said wall of a diameter slightly greater than said inner diameter, and a shoulder between said regions.

2. The block defined in claim 1 wherein said wall is rectangular, said apron having four joined-together rectangular portions.

3. The block defined in claim 2 wherein an even number of said tubes are provided on said block in a regular array.

4. The block defined in claim 3 wherein said tubes are spaced from said apron and from one another with all-around clearance.

* * * * *